United States Patent [19]

Reymann

[11] 4,185,561

[45] Jan. 29, 1980

[54] AUTOMATIC SWITCHING SYSTEM

[76] Inventor: Joseph Reymann, 953 Avenida Ladera, San Dimas, Calif. 91773

[21] Appl. No.: 817,981

[22] Filed: Jul. 22, 1977

[51] Int. Cl.[2] ..... B61B 13/12; B60L 9/00

[52] U.S. Cl. ..... 104/153; 104/148 R; 104/149; 104/DIG. 1; 191/2; 307/138; 361/246

[58] Field of Search ..... 104/147 R, 147 A, 148 R, 104/149, 151, 153, DIG. 1; 105/1 T; 46/1 K, 212, 216, 217, 257, 258, 259, 260, 262; 191/2, 6; 307/127, 138; 320/26; 361/246; 238/10 E

[56] References Cited

U.S. PATENT DOCUMENTS

| | | | |
|---|---|---|---|
| 434,871 | 8/1890 | Hunter | 104/153 |
| 1,857,760 | 5/1932 | Loughridge | 104/149 X |
| 1,865,278 | 6/1932 | Rosenthal | 104/149 |
| 3,675,586 | 7/1972 | Haddad | 104/149 |
| 4,034,168 | 7/1977 | Brown | 191/2 |

*Primary Examiner*—Randolph A. Reese
*Attorney, Agent, or Firm*—Lewis Anten

[57] ABSTRACT

An automatic switching system particularly adapted for railroad hobbyists whereby the complicated polarity switching usually required is eliminated. Apparatus is associated with each insulation point in a track section (block) to sense the direction of train motion and automatically conform the polarity of the next track block upon which the train will enter if the next block is of an opposite polarity from the prior block section from which the train has left.

2 Claims, 5 Drawing Figures

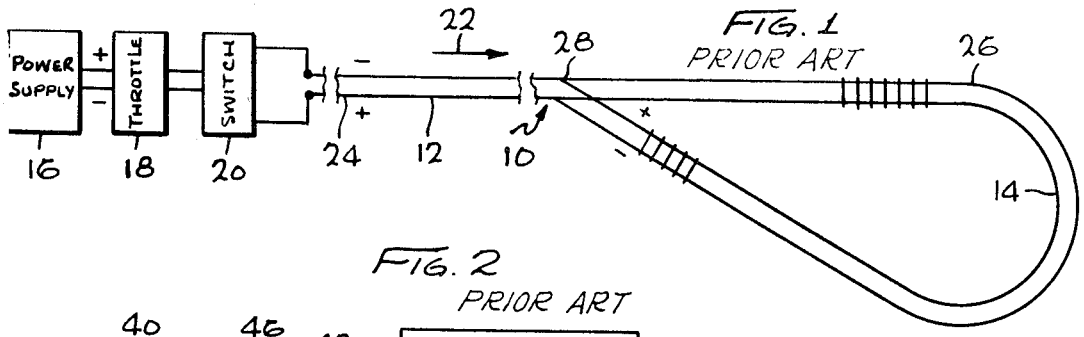
FIG. 1
PRIOR ART
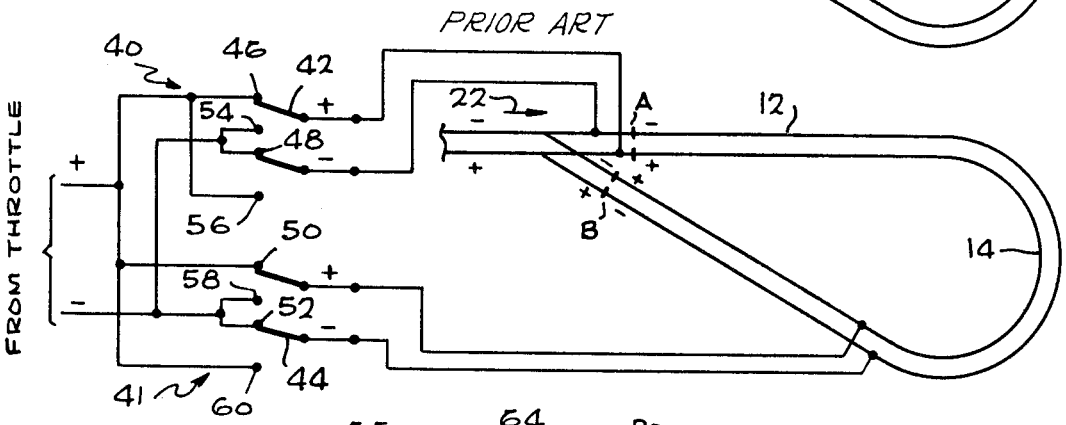
FIG. 2
PRIOR ART
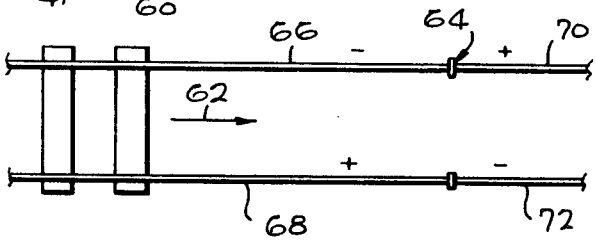
FIG. 3
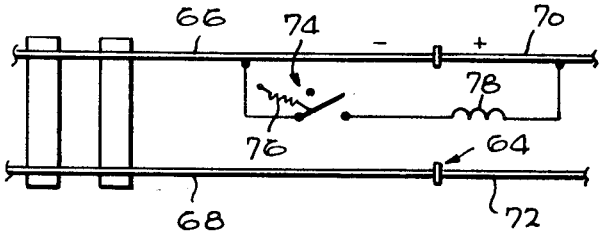
FIG. 4
FIG. 5
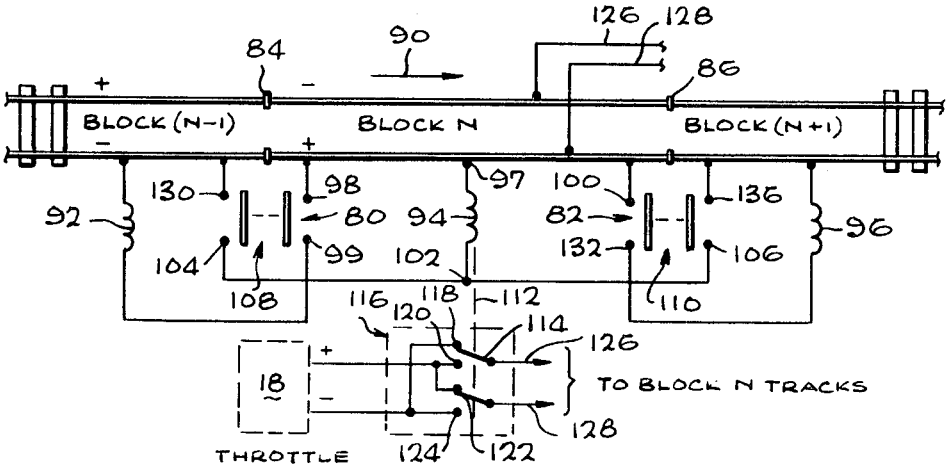

AUTOMATIC SWITCHING SYSTEM

BACKGROUND OF THE INVENTION

As is well known, there are many model railroad enthusiasts around the world, many of whom build their own model railroads. In most of these model railroads, the motive device on the model train operates on direct current in a specific manner. For example, a typical rail system may comprise a track section comprising right and left hand rails of opposite polarity. If the potential difference between the rails is of a first polarity, the train will proceed in a first direction. This applies no matter what direction the engine having the motive device is facing.

A problem arises when the hobbyist lays track in a loop having an outlet, such a configuration being extremely common in such track layouts. Normally, a direct connection of the tracks of the loop would constitute a direct short circuit across the tracks making the train inoperable. Typical prior art solutions to this problem is to insulate the loop track from the straight outlet track, thus making each section a separate block whose electrical polarity is separately switchable. For example, the train can proceed from a first or straight block to a second block or loop block on a straightaway portion. With the typical insulating arrangement described above, there is no short circuit. But when the train reaches the point where a change of polarity has been made on a loop section, the polarity is such that the motive device will be caused to reverse when crossing that particular point. Unless compensated for, the train will run back and forth across the point. In order to compensate for this, the operator usually switches the polarity of the initial straightaway block while the train is traveling on the loop so that when the train again crosses the loop insulating point, the polarity is correct for the train to continue in the opposite direction along the straightaway loop.

The aforementioned need for polarity switching unnecessarily complicates model train operation and detracts from the realism for which most railroad hobbyists strive. In addition, it is difficult for younger enthusiasts to master the switching controls of such a system, which can become very complex when the track layout includes several loops and blocks.

DESCRIPTION OF THE PRESENT INVENTION

The present invention provides a novel automatic switching system particularly adapted to use for railroad hobbyists whereby the difficult polarity switching usually required is eliminated. This present invention provides a switching system at each insulation point in each track section (block) which senses the direction of train motion and automatically switches the polarity of the next train block upon which the train will enter, such switching occurring only if that next block is of an opposite polarity from the prior block section from which the train is leaving.

A typical prior art power system utilizes a conventional double-pole double-throw switch to couple throttle power through a separate polarity-reversing switch for each block. In the system of the present invention, the conventional switch is replaced by a sensing switch and a double-pole double-throw single coil impulse relay wherein each activation of the coil automatically reverses the relay and therefore the polarity of electrical power applied to that block, through the relay. The system senses a voltage difference at the insulating junction. For example, if the train is operating on a 6-volt system, then a 6-volt difference appears on either side of the track insulator only if the polarities are different. In the present invention, a small switch may be mounted between the tracks adjacent the insulator point. The switch is a spring return type biased to an open position and which is closed or made operative by the locomotive "cowcatcher," a wheel axle, or any other device located at the beginning of the train. The switch is wired in such a way that when activated it momentarily places the relay coil across the insulating gap. If the next block is correctly polarized, i.e., of the same polarity as the preceeding block, the switching action of the relay does not take place. However, if the polarity is different, the 6-volt difference appears across the relay, the relay is impulsed which causes the next block polarity to be automatically reversed.

A switch at each block insulator operates bi-directionally so that it makes no difference from which direction the train approaches. In either event, the block next in the direction of travel is brought to the same polarity as the block the train is on. This requires a switch at each block insulation point and a single impulse relay for each track block. The sensing switch may also be a magnetic type device mounted alongside the tracks or may be replaced by various integrated circuit logic units or light sensors.

It is an object of the present invention to provide a simplified model railroad switching system for automatically applying correct polarities from a prior track block to the next succeeding track block.

It is a further object of the present invention to provide an automatic switching system for model trains which automatically switches the polarity of a track block upon which a train is entering to correspond to the polarity of the prior track block from which the train has left to allow for continuous train operation.

DESCRIPTION OF THE DRAWINGS

For better understanding of the invention as well as further objects and other features thereof reference is made to the following description which is to be read in conjunction with the following drawings wherein:

FIG. 1 shows a straight track section coupled to a loop section;

FIG. 2 shows a prior art solution to the track arrangement shown in FIG. 1;

FIG. 3 represents a track section having an insulating junction;

FIG. 4 is a simple representation of the sensing arrangement of the present invention; and FIG. 5 shows a more detailed representation of the automatic switching apparatus of the present invention.

DESCRIPTION OF THE PREFERRED EMBODIMENT

In order to provide a perspective of the present invention, a brief description of the prior problems and prior art solutions thereto is shown in FIGS. 1 and 2. In particular, FIG. 1 shows a typical prior art device for applying power to a railroad track 10 comprising straight track section 12 and loop track section 14. A power supply 16 supplies both positive and negative potential at its output which in turn is coupled to a throttle 18 for controlling the amount of power applied to the track 10. Interposed between the track 10 and throttle 18 may be a single switch 20 which applies a voltage polarity to the track sections 12 and 14. If a potential is applied to track section 10 having the polarity shown it is assumed that the motive device on the train is controlled by direct current in the manner that it will move in the direction shown by arrow 22 along the straight track section (notwithstanding what direction the engine having the source of motive power is facing).

Generally speaking, there is no problem if the hobbyist is only going to utilize a straight section of track 12 wherein the train will run in either the direction of arrow 22 or in the direction opposite thereto. However, in most situations a curved track 14 section is also utilized and coupled to the straight track section as shown in FIG. 1. The straight track section 12 runs from location 24 to location 26 and is connected to loop track section 14 at 26, the other end of the loop section 14 being connected to straight track section 12 at point 28. If the system shown in FIG. 1 was not compensated for, the direct connection of the track sections 12 and 14 would constitute a direct short circuit across the tracks at point 28 making the system inoperable.

The typical prior art solution for this problem is to insulate the loop track from the straight track section making such section a separate block whose electrical polarity is separately switchable as shown in FIG. 2. The track sections 12 and 14 are broken by two insulating members illustrated schematically as A and B, the portion of the straight loop 12 from the location 24 to A is hereinafter called block 1, the loop section between A and B being noted as block 2. For the polarities shown, the train would proceed from block 1 to block 2 in the direction of arrow 22 on the straightaway portion since the polarity of the track sections are properly correlated. Block 2 is shown such that the polarity across the insulating junction at A is the same in both blocks. The momentum of the train will carry it over the insulating junction at A, and the polarity of block 2 being the same sense as in block 1, the train will continue around the loop from A toward B. If no further actions were taken by the operator, the train would cross insulating junction B and find the track polarity in block 1 to be the reverse of block 2, causing the train to change its direction of travel and move in the reverse direction. When the train re-crosses insulating junction B in the reverse direction, it would again find a reverse polarity and change direction. Without operator action, the train would run back and forth across insulating junction B. In order to prevent this from occurring in the prior art, the operator would switch the polarity of block 1 during the time the train is traveling on block 2 such that when the train crosses B the polarity is correct for the train to continue in the reverse direction of arrow 22.

The necessity for polarity switching unnecessarily complicates the train operation in that it detracts from the realism for which most railroad hobbyists strive. In addition, it is generally difficult for younger enthusiasts to master the controls required for such a system.

FIG. 2 shows a system for controlling the track systems through a separate reversing switch 40 and 41 for each block. The voltage from the throttle 18 (not shown) is applied to a double-pole, double-throw switch 40 which in essense comprises switch arms portions 42 which are coupled between a plurality of contacts as shown. In the position illustrated, contact arms 42 are positioned at 46 and 48 and contact arms 44 are positioned at contacts 50 and 52. With switches 40 and 41 in the position shown, the polarity of the voltages applied to block 1 and block 2 are as illustrated. When the operator throws switch 40 in the reverse direction, contact arms 42 are positioned against contacts 54 and 56 reversing the polarities at block 1 from that shown in the figure. Therefore, in order to prevent the train from reversing after crossing location B the operator would throw contact arms 42 against contacts 54 and 56 at the proper time to allow the train to proceed across B in the direction reverse to arrow 22.

The polarity switching on a complex track layout containing one or more such closed loops would be too difficult for youngsters young in age, and the present invention therefore has been directed to providing an automated polarity switching system which operates at each insulation point (such as A and B above) such that the direction of train motion is sensed and the switching system automatically switches the polarity of the track block next in line with the motion of the train if and only if the next block is of opposite polarity for the direction of movement, i.e., a next-block switching system is provided.

FIG. 3 illustrates a typical situation wherein the train proceeds in the direction of arrow 62 along the track section shown. The insulating member on the track section shown is represented by reference numeral 64. In the example shown, the polarity of track portion 66 is negative with respect to track portion 68 whereas on the other side of insulating member B track portion 70 is positive with respect to track portion 72. If the train system is operating on 6 volts from the power supply throttle, then a 6-volt difference appears on either side of the insulating member 64 only if the polarities on each side are different as shown in FIG. 3.

In accordance with the teachings of the present invention, a small switch 74 may be mounted between either side of the insulating member 64, switch 74 normally being biased open by spring 76 and mounted between the track rails. Switch 74 is operated by the locomotive or engine front axle, cowcatcher or any other low part at the beginning of the train which at this point engages or closes the switch when the switch is contacted. As shown in FIG. 4, switch 74 is wired in such a way that when it is activated or engaged by the member on the train, it momentarily completes the connection to relay coil 78 across the insulating gap. If the two adjacent blocks are correctly polarized, i.e., there is no polarity difference between track portions 66 and 70, no 6-volt difference appears on either side of the track insulator and the relay 78 is not engaged. If the polarity is different (as shown in FIG. 3) a voltage difference appears on either side of the track insulating member 64 and the voltage difference impulses the relay 78, described hereinafter with reference to FIG. 5, to automatically reverse the polarity of the subsequent block in the path of the train direction to allow the train to continue motion in the desired direction.

Referring to FIG. 5, the preferred embodiment of the present invention is shown for a typical sequence of blocks. A block designated as N−1 is electrically insulated from adjacent block designated N by insulators 84. Block N is electrically separated from Block N+1 by insulators 86. The remaining blocks are likewise insulated from one another.

A first relay 92 has one terminal attached to one track of Block N−1, illustrated as the negative potential track, with its other side terminating at terminal 99. A second relay 94 has one side 97 connected to one track of block N, illustrated as the positive potential track. The other side of relay 94 is connected to terminals 104 and 106. A third relay 96 has one side connected to one track of block N+1, and its other side connected to terminal 132. Terminal 104 has an associated terminal 130 connected to block N−1, terminal 99 an associated terminal 98 connected to block N, terminal 132 an associated terminal 100 connected to block N and terminal 106 an associated terminal 136 connected to block N+1 to form terminal pairs 104-130, 99-98, 132-100 and 106-136, each pair of which may be contacted in turn by either movable switching elements 108 or 110. Movable switching elements are spring biased so as to normally not be in contact with any pair of terminals.

Each relay is coupled to a double-pole, double-throw polarity switch which is associated with each block which in turn are connected to the throttle 18 which has its power output connected to each of the separate blocks in the track lay-out through the relay/switch for that block.

The polarity switch 116 serves to reverse the potential applied to the block N when activated by relay 94.

Referring to FIG. 5, the detailed operation of the present invention is described. The switches 80 and 82 and each block insulator 84 and 86, respectively, are arranged to operate bidirectionally so that it makes no difference from which direction the train approaches so that the block next in the direction of travel is brought to the same polarity as the block the train is presently in. This necessitates a switch at each block insulation point and a single impulse relay and polarity switch for each track block. Switches 108 and 110 are so constructed that motion in the direction of arrow 90 connects contacts 130 and 140, and 100 and 132 respectively. Motion in the direction opposite to arrow 90 would connect contacts 106 and 136 of switch 110, and then contacts 98 and 99 to switch 108.

In operation, with the train in block N−1 proceeding in the direction of the arrow 90, switch 108 is positioned by the train such that contacts 104 and 130 are connected together. In this situation, the potential difference across the insulator member 84 through side 97, contacts 130, 104 and terminal 102 is placed across relay 94. With the potential differences as shown in FIG. 5, the relay 94 is activated and causes the switch 116, via relay arm 112, to move contact arm 114 to contacts 120 and 124 whereby a reverse potential is applied to block N via leads 126 and 128 such that the polarity of block N is the same as the polarity of block N−1, the train continuing to move in the direction of arrow 90. At this time, switch 108 returns to the position shown in FIG. 5. As the train proceeds in the direction of arrow 90 from block N to block N+1, switch 110 is activated and contacts 100 and 132 are connected. Relay 96 now senses a potential difference between block N and block N+1 via contacts 100 and 132 in a manner similar to that described above, and if the polarities are different, relay 96 will be impulsed, again switching a polarity switch associated with relay 96 reversing the polarity of voltage applied to block N+1 so that it conforms to that applied to block N, and the train crossing insulating junction 86 will continue in motion in the same direction.

If the train is moving in the direction opposite to arrow 90, the operation of the circuit is similar to that described above. If the train is in block N+1 moving toward block N across insulator 86, switch 110 is activated by the train in such a manner as to cause the connection of contacts 106 and 136. By action similar to that described above, the polarity of voltage applied to block N is made to conform to that applied to block N+1. As the train moves from block N to block N−1 across insulator 84, the train activates switch 108 in such a manner as to connect contacts 98 and 80, thereby applying any potential difference across relay 92 and, if required, conforming the polarity of block N−1 to block N.

The sensing switches at the insulating members may be mechanical switches mounted alongside or between or under the tracks, or they may be replaced by various integrated circuit logic units, light sensors, magnetic sensors, or similar devices.

While the invention has been described as to its preferred embodiment, it will be understood by thos skilled in the art that various changes may be made and equivalents may be substituted for elements thereof without departing from the true spirit and scope of the invention. In addition, many modifications may be made to adapt a particular situation or material to the teaching of the invention without departing from its essential teachings.

I claim:

1. An automatic polarity switching apparatus for controlling the polarity of the electrical potential applied to first and second blocks of model railroad tracks which are electrically insulated from one another, comprising:

first and second polarity switch members, each adapted to couple a means for providing such electrical potential to said first and second track blocks, respectively, said polarity switch members adapted to reverse the polarity of the potential applied to the respective track block when activated by an actuating signal;

first and second relay means, each having first and second inputs and an output, each relay means adapted to produce an actuating signal at said output when a potential is developed across said inputs, said first inputs of said first and second relay means coupled to a first rail of said respective track blocks;

bi-directional switch means actuated by the presence of a train on one of said track blocks, and adapted to couple said second input of said second relay means to said first rail of said first track block when actuated by a train on said first track block, and to couple said second input of said first relay means to said first rail of said second track block when actuated by a train on said second track block; and said outputs of said first and second relay means coupled to said first and second polarity switch means, respectively, for activating one of said polarity switch members to change the polarity of the potential applied to one of said track blocks to be the same as the potential applied to the other track block;

whereby a train proceeding from either one of said track blocks to the other track block will actuate the switching apparatus so that the polarity of the potential of the next-to-be-encountered track block is the same as the polarity of the block on which the train is currently traveling.

2. The apparatus of claim 1 wherein said bi-directional switch means is mechanical and activated by contact of a switch means element with a portion of said train.

* * * * *